US010503090B2

(12) United States Patent
Tominaga et al.

(10) Patent No.: US 10,503,090 B2
(45) Date of Patent: Dec. 10, 2019

(54) TONER

(71) Applicant: CANON KABUSHIKI KAISHA, Tokyo (JP)

(72) Inventors: Tsuneyoshi Tominaga, Suntou-gun (JP); Akane Masumoto, Suntou-gun (JP); Toshihiko Katakura, Kashiwa (JP); Shiro Kuroki, Suntou-gun (JP); Kenta Kamikura, Yokohama (JP); Sara Yoshida, Mishima (JP); Shinsuke Mochizuki, Yokohama (JP); Tsutomu Shimano, Mishima (JP); Kentaro Yamawaki, Mishima (JP); Tomonori Matsunaga, Suntou-gun (JP); Kunihiko Nakamura, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/969,318

(22) Filed: May 2, 2018

(65) Prior Publication Data

US 2018/0329332 A1 Nov. 15, 2018

(30) Foreign Application Priority Data

May 15, 2017 (JP) ..... 2017-096504
May 15, 2017 (JP) ..... 2017-096534
May 15, 2017 (JP) ..... 2017-096544

(51) Int. Cl.

| | |
|---|---|
| ***G03G 9/093*** | (2006.01) |
| ***G03G 9/097*** | (2006.01) |
| ***G03G 9/08*** | (2006.01) |
| ***G03G 9/087*** | (2006.01) |
| ***G03G 9/113*** | (2006.01) |
| *G03G 9/083* | (2006.01) |
| *G03G 9/107* | (2006.01) |

(52) U.S. Cl.

CPC ..... *G03G 9/09328* (2013.01); *G03G 9/08* (2013.01); *G03G 9/0819* (2013.01); *G03G 9/0821* (2013.01); *G03G 9/0825* (2013.01); *G03G 9/08711* (2013.01); *G03G 9/08755* (2013.01); *G03G 9/08773* (2013.01); *G03G 9/09307* (2013.01); *G03G 9/09342* (2013.01); *G03G 9/09364* (2013.01); *G03G 9/09371* (2013.01); *G03G 9/09392* (2013.01); *G03G 9/09708* (2013.01); *G03G 9/09783* (2013.01); *G03G 9/1136* (2013.01); *G03G 9/0833* (2013.01); *G03G 9/107* (2013.01)

(58) Field of Classification Search

CPC ..... G03G 9/093; G03G 9/09314; G03G 9/09328; G03G 9/09321; G03G 9/09307; G03G 9/09392; G03G 9/0821

USPC ..... 430/110.2

See application file for complete search history.

(56) References Cited

U.S. PATENT DOCUMENTS

| | | | | |
|---|---|---|---|---|
| 4,952,476 | A | 8/1990 | Sakashita et al. | |
| 4,985,327 | A | 1/1991 | Sakashita et al. | |
| 5,014,089 | A | 5/1991 | Sakashita et al. | |
| 5,202,213 | A | 4/1993 | Nakahara et al. | |
| 5,532,101 | A | 7/1996 | Nozawa et al. | |
| 5,534,982 | A | 7/1996 | Sakashita et al. | |
| 5,731,122 | A | 3/1998 | Yoshida et al. | |
| 5,774,771 | A | 6/1998 | Kukimoto et al. | |
| 5,915,150 | A | 6/1999 | Kukimoto et al. | |
| 5,948,584 | A | 9/1999 | Hashimoto et al. | |
| 5,998,080 | A | 12/1999 | Ohno et al. | |
| 6,214,509 | B1 | 4/2001 | Kasuya et al. | |
| 6,300,024 | B1 | 10/2001 | Yusa et al. | |
| 6,337,169 | B1 | 1/2002 | Hashimoto et al. | |
| 6,358,658 | B1 * | 3/2002 | Tazawa | G03G 9/0825 430/110.1 |
| 6,696,211 | B2 | 2/2004 | Yoshida et al. | |
| 6,806,016 | B2 | 10/2004 | Ohno et al. | |
| 7,858,283 | B2 | 12/2010 | Ishigami et al. | |
| 7,927,775 | B2 | 4/2011 | Komatsu et al. | |
| 7,939,233 | B2 | 5/2011 | Inoue et al. | |
| 8,137,886 | B2 | 3/2012 | Baba et al. | |
| 8,142,972 | B2 | 3/2012 | Hotta et al. | |
| 8,372,573 | B2 | 2/2013 | Ayaki et al. | |
| 8,383,313 | B2 | 2/2013 | Ayaki et al. | |
| 8,551,680 | B2 | 10/2013 | Ayaki et al. | |
| 8,574,801 | B2 | 11/2013 | Itabashi et al. | |
| 8,609,312 | B2 | 12/2013 | Itabashi et al. | |
| 8,822,120 | B2 | 9/2014 | Abe et al. | |
| 8,828,639 | B2 | 9/2014 | Kamikura et al. | |
| 8,986,914 | B2 | 3/2015 | Fujikawa et al. | |

(Continued)

FOREIGN PATENT DOCUMENTS

| | | |
|---|---|---|
| JP | 2011-064868 A | 3/2011 |
| JP | 2016-103005 A | 6/2016 |

OTHER PUBLICATIONS

U.S. Appl. No. 15/973,661, Kenta Kamikura, filed May 8, 2018.

(Continued)

*Primary Examiner* — Janis L Dote

(74) *Attorney, Agent, or Firm* — Venable LLP

(57) ABSTRACT

Provided is a toner containing a colorant and a binder resin, wherein, in a wettability test of the toner with respect to a methanol/water mixed solvent, the methanol concentration when the transmittance of light at a wavelength of 780 nm is 50% is at least 5.0 volume % and not more than 30.0 volume %, and the interparticle force measured by rupturing a consolidation of the toner formed by compression of the toner with a load of 78.5 N is at least 1.0 nN and not more than 25.0 nN.

5 Claims, 4 Drawing Sheets

(56) References Cited

U.S. PATENT DOCUMENTS

| | | | |
|---|---|---|---|
| 9,029,056 | B2 | 5/2015 | Kenmoku et al. |
| 9,034,549 | B2 | 5/2015 | Shiotari et al. |
| 9,098,002 | B2 | 8/2015 | Kenmoku et al. |
| 9,098,003 | B2 | 8/2015 | Masumoto et al. |
| 9,158,216 | B2 | 10/2015 | Shimano et al. |
| 9,261,806 | B2 | 2/2016 | Moribe et al. |
| 9,285,697 | B2 | 3/2016 | Fukudome et al. |
| 9,341,967 | B2 | 5/2016 | Tsujino et al. |
| 9,366,981 | B2 | 6/2016 | Yamawaki et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,594,323 | B2 | 3/2017 | Fujikawa et al. |
| 9,599,919 | B2 | 3/2017 | Isono et al. |
| 9,720,340 | B2 | 8/2017 | Tominaga et al. |
| 9,733,583 | B2 | 8/2017 | Kuroki et al. |
| 9,733,584 | B2 | 8/2017 | Masumoto et al. |
| 9,785,071 | B2 | 10/2017 | Shimano et al. |
| 9,785,077 | B2 | 10/2017 | Abe et al. |
| 9,829,816 | B2 | 11/2017 | Tanaka et al. |
| 9,829,820 | B2 | 11/2017 | Masumoto et al. |
| 9,835,964 | B2 | 12/2017 | Yoshida et al. |
| 9,880,478 | B2 | 1/2018 | Shimano et al. |
| 9,897,932 | B2 | 2/2018 | Hotta et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 2001/0018158 | A1 | 8/2001 | Yoshida et al. |
| 2009/0233212 | A1 | 9/2009 | Fujikawa et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0065174 | A1 | 3/2013 | Itabashi et al. |
| 2015/0248071 | A1 | 9/2015 | Katsura et al. |
| 2016/0299446 | A1 | 10/2016 | Kuroki et al. |
| 2016/0327882 | A1* | 11/2016 | Isono ..... G03G 9/08788 |
| 2016/0349649 | A1* | 12/2016 | Mochizuki ..... G03G 9/09321 |
| 2017/0123333 | A1 | 5/2017 | Kuroki et al. |
| 2017/0299972 | A1 | 10/2017 | Tanaka et al. |

OTHER PUBLICATIONS

U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.

* cited by examiner

TONER

BACKGROUND OF THE INVENTION

Field of the Invention

The present invention relates to toner for developing the electrostatic images used in image-forming methods such as electrophotography and electrostatic printing.

Description of the Related Art

Copiers and printers have in recent years entered into use in new market sectors, and higher printing speeds and high image stabilities are being required for use in a variety of environments. For example, printers, which have previously been used mainly in offices with their controlled temperature and humidity, have also entered into use in demanding high-temperature, high-humidity environments.

In order to maintain an excellent developing performance in high-temperature, high-humidity environments, Japanese Patent Application Laid-open No. 2011-064868 discloses a toner to which surface-treated inorganic fine particles have been externally added, and which has a controlled toner wettability.

A toner having a controlled toner interparticle force is disclosed in Japanese Patent Application Laid-open No. 2016-103005.

SUMMARY OF THE INVENTION

There have been problems in low-temperature, low-humidity environments with the toner disclosed in Japanese Patent Application Laid-open No. 2011-064868, i.e., the occurrence of control defects caused by a charging phenomenon, and a decline in the solid image compliance performance caused by a decline in toner flowability. The control defects here refer to image defects produced by adherence of the toner to the toner bearing member.

On the other hand, the toner disclosed in Japanese Patent Application Laid-open No. 2016-103005, while providing a suppression of fogging in high-temperature, high-humidity environments, has presented the problems in low-temperature, low-humidity environments of a reduction in toner flowability and thus a reduction in the solid image compliance performance.

For these reasons, there is desire for the development of a toner that, in both high-temperature, high-humidity environments and low-temperature, low-humidity environments, would exhibit an excellent solid image compliance performance and would suppress the occurrence of control defects.

The present invention provides a toner that, in both high-temperature, high-humidity environments and low-temperature, low-humidity environments, exhibits an excellent solid image compliance performance and suppresses the occurrence of control defects.

The present invention is a toner containing a colorant and a binder resin, wherein, in a wettability test of the toner with respect to a methanol/water mixed solvent, the methanol concentration when the transmittance of light at a wavelength of 780 nm is 50% is at least 5.0 volume % and not more than 30.0 volume %; and the interparticle force measured by rupturing a consolidation of the toner formed by compression of the toner with a load of 78.5 N is at least 1.0 nN and not more than 25.0 nN.

The present invention can thus provide a toner that, in both high-temperature, high-humidity environments and low-temperature, low-humidity environments, exhibits an excellent solid image compliance performance and suppresses the occurrence of control defects.

Further features of the present invention will become apparent from the following description of exemplary embodiments with reference to the attached drawings.

DESCRIPTION OF THE EMBODIMENTS

Figure 1:
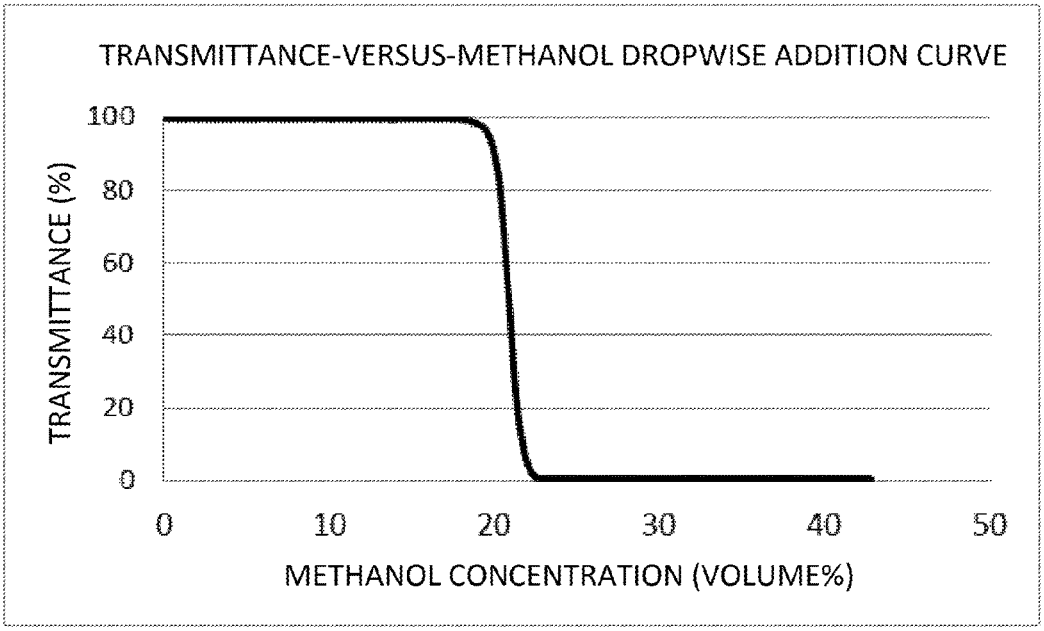
FIG. 1 is a graph showing an example of the transmittance-versus-methanol dropwise addition curve in the wettability test.

Unless specifically indicated otherwise, the phrases "at least XX and not more than YY" and "XX to YY" indicating numerical value ranges refer to numerical value ranges that include the lower limit and upper limit that are provided as the end points.

The present invention is a toner containing a colorant and a binder resin, wherein, in a wettability test of the toner with respect to a methanol/water mixed solvent, the methanol concentration when the transmittance of light at a wavelength of 780 nm is 50% is at least 5.0 volume % and not more than 30.0 volume %; and the interparticle force measured by rupturing a consolidation of the toner formed by compression of the toner with a load of 78.5 N is at least 1.0 nN and not more than 25.0 nN.

In a high-temperature, high-humidity environment, a decline in the amount of charge on the toner and a decline in toner flowability are occurred due to the adsorption of moisture by the toner or external additive. As a result, fogging can be occurred, as can a reduction in the solid image compliance performance. As a consequence, there have been efforts in the past to solve these problems by the execution of a hydrophobic treatment on the external additive.

The use of a hydrophobed external additive does suppress moisture adsorption, but, on the other land, the charge imparted to the toner does not leak and control defects caused by a charging phenomenon are occurred in particular in low-temperature, low-humidity environments.

The present inventors therefore came to the idea that these problems could be solved in high-temperature, high-humidity environments and low-temperature, low-humidity environments if the amount of charge on the toner and the toner flowability were not reduced in a state in which the hydrophilicity of the toner has been increased.

The present inventors obtained the following knowledge as a result of focused investigations:

toner hydrophilicity can be controlled through the wettability with respect to a methanol/water mixed solvent;

the toner flowability, on the other hand, is enhanced by reducing the interparticle force in the toner;

by reducing this interparticle force, aggregation of the toner in the developing device is suppressed and the toner can be rapidly mobilized; and an excellent charging performance is exhibited as a result.

That is, it was discovered that the aforementioned problems could be solved by adjusting the toner interparticle force in a state in which the hydrophilicity of the toner has been increased.

In a wettability test of the toner with respect to a methanol/water mixed solvent, the methanol concentration when the transmittance of light at a wavelength of 780 nm is 50% (this methanol concentration is referred to in the following as TA and also as the wettability) is at least 5.0 volume % and not more than 30.0 volume %. This methanol concentration is preferably at least 5.0 volume % and not more than 20.0 volume %.

When this methanol concentration is in the indicated range, the toner has a high hydrophilicity and a charging phenomenon in low-temperature, low-humidity environments can be prevented. The details of the method for measuring this methanol concentration are provided below.

On the other hand, the interparticle force, as measured by rupturing a consolidation of the toner formed by compression of the toner with a load of 78.5 N, is at least 1.0 nN and not more than 25.0 nN. This interparticle force is preferably at least 3.0 nN and not more than 20.0 nN and is more preferably at least 3.0 nN and not more than 17.0 nN.

For this interparticle force, a consolidation of the toner is formed by applying a perpendicular load of 78.5 N on the toner filled in a cylindrical cell that can be vertically split in two. The toner consolidation is then drawn, and the interparticle force is calculated based on the maximum tensile rupture strength obtained when the toner consolidation undergoes rupture.

The compression condition of 78.5 N is the value hypothesized for the load applied when the toner consolidated in the cartridge passes past the control member.

When the interparticle force is in the indicated range, even in high-temperature, high-humidity environments there is no aggregation of the toner at the control member within the cartridge and the solid image compliance performance is then excellent. The details of the method for measuring the interparticle force are given below.

Moreover, electrostatic aggregation can be suppressed by satisfying the aforementioned methanol concentration (TA) and interparticle force, and the solid image compliance performance is then also excellent in low-temperature, low-humidity environments.

There are no particular limitations on the means for adjusting the methanol concentration (TA) and the interparticle force into the ranges indicated above. However, this is difficult to achieve by using the surface layer of the organic resins used in ordinary toners or by means of the external addition of surface-treated inorganic fine particles.

A configuration in which the toner has a surface layer that contains an organosilicon polymer is an example of a means for adjusting the methanol concentration (TA) and the interparticle force into the ranges indicated above.

The wettability of the toner surface can be favorably controlled by incorporating an organosilicon polymer in the surface layer of the toner. On the other hand, an increased interparticle force can prevent moisture absorption into the surface layer and interior of the toner.

Through material selection, the wettability and interparticle force can be adjusted through, for example, the number of carbon chains and the number of carbons in the functional groups that are directly bonded to the silicon atoms in the organosilicon polymer.

The wettability and interparticle force can also be controlled using, for example, adjustment of the peak-and-valley shape of the surface layer containing the organosilicon polymer and adjustment of the network structure that connects between the peaks.

These adjustments can be made in the step of forming an organosilicon polymer-containing surface layer on the toner, through, for example, the modality and timing of addition of the organosilicon polymer and the pH, temperature, and time during pretreatment of the organosilicon polymer.

Specific examples are described in the following, but this does not imply a limitation thereto or thereby.

A core particle dispersion is first obtained by preparing toner core particles containing binder resin and colorant and dispersing these toner core particles in an aqueous medium. The core particle concentration here is preferably at least 10 mass % and not more than 40 mass % for the core particle solids fraction with reference to the total amount of the core particle dispersion. The temperature of the core particle dispersion is preferably adjusted to at least 35° C. on a preliminary basis. In addition, the pH of this core particle dispersion is preferably adjusted to a pH that inhibits the occurrence of organosilicon compound condensation. The pH that inhibits the occurrence of organosilicon compound condensation varies with the particular substance, and as a consequence within ±0.5 centered on the pH at which the reaction is most inhibited is preferred.

The organosilicon compound used, on the other hand, has preferably been subjected to a hydrolysis treatment.

An example in this regard is a method in which hydrolysis has been carried out on a preliminary basis in a separate vessel as a pretreatment of the organosilicon compound. The charge concentration for the hydrolysis, using 100 mass parts for the amount of the organosilicon compound, is preferably at least 40 mass parts and not more than 500 mass parts of water from which the ion fraction has been removed, e.g., deionized water or RO water, and is more preferably at least 100 mass parts and not more than 400 mass parts of water.

The hydrolysis conditions are preferably as follows: pH of at least 2 and not more than 7, temperature of at least 15° C. and not more than 80° C., and time of at least 30 minutes and not more than 600 minutes.

By mixing the core particle dispersion with the resulting hydrolysis solution of the organosilicon compound and adjusting to a pH suitable for condensation of the organosilicon compound (preferably at least 6 and not more than 12 or at least 1 and not more than 3 and more preferably at least 8 and not more than 12), attachment as a surface layer to the toner core particle surface can be achieved while inducing condensation of the organosilicon compound. Condensation and attachment as a surface layer are preferably executed for at least 60 minutes at at least 35° C. In addition, the macrostructure of the surface can be adjusted by adjusting the holding time at at least 35° C. prior to adjusting to a pH suitable for condensation, and this holding time is preferably at least 3 minutes and not more than 120 minutes.

It is thought that, using this method, the hydrophilicity is increased by reducing the reactive residues in the organosilicon polymer and increasing the proportion of the —Si—O—Si— structure.

Moreover, it is thought that exposure of the resin portion of the core particle is suppressed and the interparticle force can be reduced, because the obtained surface layer forms a peak-and-valley configuration and a network is also formed between the peaks.

When an organosilicon polymer-containing surface layer is used, the content of the organosilicon polymer in the toner is preferably at least 0.5 mass % and not more than 5.0 mass % and is more preferably at least 1.5 mass % and not more than 5.0 mass %.

The durability of the toner can be improved by having the content of the organosilicon polymer be in the indicated range. The content of the organosilicon polymer can be controlled through the type and amount of the organosilicon compound used to form the organosilicon polymer and through the production method, reaction temperature, reaction solvent, and pH used during formation of the organosilicon polymer. The method for measuring the organosilicon polymer content is described below.

When an organosilicon polymer-containing surface layer is used, the fixing ratio of the organosilicon polymer to the toner is preferably at least 90.0% and not more than 100.0% and is more preferably at least 92.0% and not more than 99.0%.

When the fixing ratio is in the indicated range, there is little peeling or exfoliation of the organosilicon polymer and melt adhesion to members within the cartridge does not occur, and as a consequence the occurrence of development streaks is suppressed even during extended print runs. The method for measuring the fixing ratio of the organosilicon polymer to the toner is described below.

The fixing ratio can be adjusted into the range given above through, for example, the production method, reaction temperature, reaction time, reaction solvent, and pH used during formation of the organosilicon polymer.

The organosilicon polymer is preferably a polymer having a structure represented by formula ($R^aT3$) below.

$$R^a—SiO_{3/2} \quad (R^aT3)$$

[$R^a$ in formula ($R^aT3$) represents a hydrocarbon group having at least 1 and not more than 6 carbons or a vinyl polymer segment containing a substructure represented by formula (i) or formula (ii) below.]

(i)

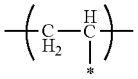

(ii)

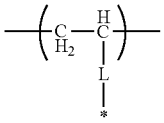

[where, * in formulas (i) and (ii) represents a binding segment with an element Si in the structure represented by formula ($R^aT3$), and L in formula (ii) represents an alkylene group or arylene group.]

The alkylene group is preferably the methylene group and the arylene group is preferably the phenylene group.

By having the aforementioned structure be present in the organosilicon polymer, the charge on the toner surface flows rapidly and the charge rising performance of the toner is improved. As a result, toner on the toner bearing member is supplied even immediately after the output of a solid image and the solid image compliance performance is further improved.

Of the four valence electrons on the Si atom in the formula ($R^aT3$), one participates in the bond with $R^a$ and the remaining three participate in the bonds to the O atoms. The O atom has a configuration in which the two valence electrons both participate in bonds with Si atoms, that is, it constitutes the siloxane bond (Si—O—Si).

Considered as the Si atoms and O atoms in an organosilicon polymer, three O atoms are present for two Si atoms and this is then represented as $—SiO_{3/2}$.

The presence of the siloxane polymer segment ($—SiO_{3/2}$) in the formula ($R^aT3$) can be confirmed by $^{29}$Si-NMR measurement on the tetrahydrofuran-insoluble matter in the toner.

The presence of the structures represented by formula (i) and formula (ii) can be confirmed by $^{13}$C-NMR measurement of the tetrahydrofuran-insoluble matter of the toner.

In the chart yielded by $^{29}$Si-NMR measurement on the tetrahydrofuran-insoluble matter in the toner, the percentage for the peak area assigned to the formula ($R^aT3$) structure with reference to the total peak area for the organosilicon polymer is preferably at least 20%.

The sol-gel method is an example of a method for producing the organosilicon polymer.

In the sol-gel method, a liquid starting material is used for the starting material, and hydrolysis and condensation polymerization are carried out to induce gelation while passing through a sol state, and this method is used for the synthesis of glasses, ceramics, organic-inorganic hybrids, and nanocomposites. The use of this production method supports the production, from the liquid phase at low temperatures, of functional materials having various shapes, e.g., surface layers, fibers, bulk forms, and fine particles.

In specific terms, the organosilicon polymer present in the surface layer of the toner is preferably produced by the hydrolysis and condensation polymerization of a silicon compound as represented by alkoxysilanes.

Through the disposition in the toner of a surface layer containing this organosilicon polymer, a toner can be obtained that has an improved environmental stability, is resistant to reductions in toner performance during long-term use, and exhibits an excellent storage stability.

The sol-gel method can produce a variety of fine structures and shapes because it starts from a liquid and forms a material through gelation of this liquid. In particular, when a toner is produced in an aqueous medium, precipitation on the toner surface is readily brought about by the hydrophilicity due to the hydrophilic groups, such as the silanol group, in the organosilicon compound. The aforementioned fine structure and shape can be adjusted through, for example, the reaction temperature, reaction time, reaction solvent, and pH and the type and amount of the organometal compound.

The organosilicon polymer contained in the surface layer preferably is a condensation polymer from an organosilicon compound having the structure represented by formula (Z) below.

(Z)

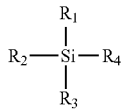

[In formula (Z), $R_1$ represents a hydrocarbon group and $R_2$, $R_3$, and $R_4$ each independently represent a halogen atom, hydroxy group, acetoxy group, or alkoxy group.]

Here, $R_1$ is a functional group that becomes the $R^a$ in formula ($R^aT3$) and also encompasses structures represented by formula (A) and formula (B) below.

$$*—CH{=}CH_2 \quad (A)$$

$$*\text{-}L\text{-}CH{=}CH_2 \quad (B)$$

[In formulas (A) and (B), * represents a binding segment with an element Si in the structure represented by formula (Z), and L in formula (B) represents an alkylene group or arylene group.]

The alkylene group is preferably the methylene group and the arylene group is preferably the phenylene group.

The hydrophobicity can be enhanced by the hydrocarbon group of $R_1$ and a toner having an excellent environmental stability can then be obtained. In addition, an aryl group, which is an aromatic hydrocarbon group and is exemplified by the phenyl group, can also be used as the hydrocarbon group. When $R_1$ exhibits a large hydrophobicity, a trend is exhibited of large fluctuations in the amount of charge in different environments, and thus, considering the environmental stability, $R_1$ is more preferably an aliphatic hydrocarbon group having at least 1 and not more than 3 carbons and is still more preferably an alkyl group having at least 1 and not more than 3 carbons.

$R_2$, $R_3$, and $R_4$ are each independently a halogen atom, hydroxy group, acetoxy group, or alkoxy group (also referred to in the following as reactive groups). These reactive groups form a crosslinked structure by undergoing hydrolysis, addition polymerization, and condensation polymerization, and a toner can then be obtained that exhibits an excellent resistance to component contamination and an excellent development durability.

The alkoxy group is preferred considering its gentle hydrolyzability at room temperature and the ability to precipitate on and coat the toner surface, and the methoxy group and ethoxy group are more preferred.

The hydrolysis, addition polymerization, and condensation polymerization of $R_2$, $R_3$, and $R_4$ can be controlled through the reaction temperature, reaction time, reaction solvent, and pH.

In order to obtain the organosilicon polymer, a single organosilicon compound having three reactive groups ($R_2$, $R_3$, and $R_4$) in the molecule excluding the $R_1$ in formula (Z) (such an organosilicon compound is also referred to below as a trifunctional silane) may be used, or a combination of a plurality of such organosilicon compounds may be used.

Organosilicon compounds having the structure represented by formula (Z) can be exemplified by the following:

trifunctional vinylsilanes such as vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane; trifunctional allylsilanes such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane; trifunctional methylsilanes such as p-styryltrimethoxysilane, methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional ethylsilanes such as ethyltrimethoxysilane, ethyltriethoxysilane, ethyltrichlorosilane, ethyltriacetoxysilane, and ethyltrihydroxysilane; trifunctional propylsilanes such as propyltrimethoxysilane, propyltriethoxysilane, propyltrichlorosilane, propyltriacetoxysilane, and propyltrihydroxysilane; trifunctional butylsilanes such as butyltrimethoxysilane, butyltriethoxysilane, butyltrichlorosilane, butyltriacetoxysilane, and butyltrihydroxysilane; trifunctional hexylsilanes such as hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane. A single organosilicon compound may be used by itself or a combination of two or more may be used.

The content of the organosilicon compound having the structure represented by formula (Z) in the organosilicon polymer as a result of hydrolysis and polycondensation is preferably at least 50 mol % and is more preferably at least 60 mol %.

An organosilicon compound having four reactive groups in the molecule (tetrafunctional silane), an organosilicon compound having three reactive groups in the molecule (trifunctional silane), an organosilicon compound having two reactive groups in the molecule (difunctional silane), or an organosilicon compound having one functional group (monofunctional silane) may also be used in addition to the organosilicon compound having the structure represented by formula (Z). The following are examples:

dimethyldiethoxysilane, tetraethoxysilane, hexamethyldisilazane, 3-glycidoxypropyltrimethoxysilane, 3-glycidoxypropylmethyldimethoxysilane, 3-glycidoxypropylmethyldiethoxysilane, 3-glycidoxypropyltriethoxysilane, 2-(3,4-epoxycyclohexyl)ethyltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, N-2-(aminoethyl)-3-aminopropyltrimethoxysilane, N-2-(aminoethyl)-3-aminopropyltriethoxysilane, N-2-(aminoethyl)-3-aminopropylmethyldimethoxysilane, N-phenyl-3-aminopropyltrimethoxysilane, 3-ureidopropyltriethoxysilane, 3-chloropropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, bis(triethoxysilylpropyl)tetrasulfide, trimethylsilyl chloride, triethylsilyl chloride, triisopropylsilyl chloride, t-butyldimethylsilyl chloride, N,N'-bis(trimethylsilyl)urea, N,O-bis(trimethylsilyl)trifluoroacetamide, trimethylsilyl trifluoromethanesulfonate, 1,3-dichloro-1,1,3,3-tetraisopropyldisiloxane, trimethylsilylacetylene, hexamethyldisilane, 3-isocyanatopropyltriethoxysilane, tetraisocyanatosilane, methyltriisocyanatosilane, and vinyltriisocyanatosilane.

The toner core particle is preferably in gapless contact with the surface layer containing the organosilicon polymer. As a consequence, the generation of bleed out by, for example, the resin component, release agent, and so forth, in the interior from the toner surface layer is restrained and a toner can be obtained that exhibits an excellent storage stability, an excellent environmental stability, and an excellent development durability.

Besides the organosilicon polymer, the surface layer may contain, for example, various additives and resins such as styrene-acrylic copolymer resins, polyester resins and urethane resins.

[Binder Resin]

The toner contains a binder resin. There are no particular limitations on this binder resin, and heretofore known binder resins can be used. Preferred examples of the binder resin are vinyl resins, polyester resins, and the like. The following resins and polymers are examples of the vinyl resins, polyester resins, and other binder resins:

homopolymers of styrene and its substituted forms, such as polystyrene and polyvinyltoluene; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic and alicyclic hydrocarbon resins, and aromatic petroleum resins. A single one of these binder resins may be used by itself or a mixture may be used.

From the standpoint of the charging performance, the binder resin preferably contains the carboxy group and is preferably a resin produced by using a carboxy group-containing polymerizable monomer.

This polymerizable monomer can be exemplified by acrylic acid; α-alkyl unsaturated carboxylic acids and β-alkyl unsaturated carboxylic acids, such as methacrylic acid, α-ethylacrylic acid, and crotonic acid; unsaturated dicarboxylic acids such as fumaric acid, maleic acid, citraconic acid, and itaconic acid; and the unsaturated monoester derivatives of dicarboxylic acids, such as monoacryloyloxyethyl succinate, monoacryloyloxyethylene succinate, monoacryloyloxyethyl phthalate, and monomethacryloyloxyethyl phthalate.

The condensation polymers of a carboxylic acid component and alcohol component as exemplified below can be used as the polyester resin.

The carboxylic acid component can be exemplified by terephthalic acid, isophthalic acid, phthalic acid, fumaric acid, maleic acid, cyclohexanedicarboxylic acid, and trimellitic acid.

The alcohol component can be exemplified by bisphenol A, hydrogenated bisphenol, ethylene oxide adducts on bisphenol A, propylene oxide adducts on bisphenol A, glycerol, trimethylolpropane, and pentaerythritol.

The polyester resin may be a urea group-bearing polyester resin. The carboxy group in the polyester resin, e.g., in terminal position, is preferably not capped.

The binder resin in the toner may have a polymerizable functional group with the goal of improving the viscosity change by the toner upon exposure to high temperatures. This polymerizable functional group is exemplified by the vinyl group, isocyanate group, epoxy group, amino group, carboxy group, and hydroxy group.

[Crosslinking Agent]

A crosslinking agent may be added to the polymerization of the polymerizable monomer in order to control the molecular weight of the binder resin.

Examples in this regard are ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis(4-acryloxypolyethoxyphenyl)propane, 1,3-butylene glycol diacrylate, 1,4-butanediol diacrylate, 1,5-pentanediol diacrylate, 1,6-hexanediol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester-type diacrylates (MANDA, Nippon Kayaku Co., Ltd.), and crosslinking agents provided by converting the acrylates given above to the methacrylates.

The amount of addition for the crosslinking agent is preferably at least 0.001 mass parts and not more than 15.000 mass parts per 100 mass parts of the polymerizable monomer.

[Release Agent]

The toner may contain a release agent. The release agent can be exemplified by petroleum waxes, e.g., paraffin waxes, microcrystalline waxes, and petrolatum, and derivatives thereof; montan wax and derivatives thereof; hydrocarbon waxes provided by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; fatty acids such as stearic acid and palmitic acid, and compounds thereof; acid amide waxes; ester waxes; ketones; hydrogenated castor oil and derivatives thereof; plant waxes; animal waxes; and silicone resins. The derivatives here include oxides and the block copolymers and graft modifications with vinyl monomers.

The release agent content is preferably at least 5.0 mass parts and not more than 20.0 mass parts per 100.0 mass parts of the binder resin or polymerizable monomer.

[Colorant]

The toner contains a colorant. There are no particular limitations on the colorant, and, for example, known colorants as indicated below can be used.

Yellow pigments can be exemplified by yellow iron oxide and condensed azo compounds, isoindolinone compounds, anthraquinone compounds, azo metal complexes, methine compounds, and allylamide compounds, such as Naples Yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Lake. Specific examples are as follows:

C. I. Pigment Yellow 12, 13, 14, 15, 17, 62, 74, 83, 93, 94, 95, 109, 110, 111, 128, 129, 147, 155, 168, and 180.

Orange pigments can be exemplified by the following:

Permanent Orange GTR, Pyrazolone Orange, Vulcan Orange, Benzidine Orange G, Indanthrene Brilliant Orange RK, and Indanthrene Brilliant Orange GK.

Red pigments can be exemplified by bengala and condensed azo compounds, diketopyrrolopyrrole compounds, anthraquinone compounds, quinacridone compounds, basic dye lake compounds, naphthol compounds, benzimidazolone compounds, thioindigo compounds, and perylene compounds, such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, and Alizarin Lake. Specific examples are as follows:

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Blue pigments can be exemplified by copper phthalocyanine compounds and derivatives thereof, anthraquinone compounds, and basic dye lake compounds, such as Alkali Blue Lake, Victoria Blue Lake, Phthalocyanine Blue, metal-free Phthalocyanine Blue, Phthalocyanine Blue partial chloride, Fast Sky Blue, and Indanthrene Blue BG. Specific examples are as follows:

C. I. Pigment Blue 1, 7, 15, 15:1, 15:2, 15:3, 15:4, 60, 62, and 66.

Purple pigments are exemplified by Fast Violet B and Methyl Violet Lake.

Green pigments are exemplified by Pigment Green B, Malachite Green Lake, and Final Yellow Green G. White pigments are exemplified by zinc white, titanium oxide, antimony white, and zinc sulfide.

Black pigments are exemplified by carbon black, aniline black, nonmagnetic ferrite, magnetite, and black pigments provided by color mixing using the aforementioned yellow colorants, red colorants, and blue colorants to give a black color. A single one of these colorants may be used by itself, or a mixture of these colorants may be used, and these colorants may be used in a solid solution state.

As necessary, surface modification may be carried out by executing a surface treatment on the colorant using a substance that does not inhibit polymerization.

The content of the colorant is preferably at least 3.0 mass parts and not more than 15.0 mass parts per 100.0 mass parts of the binder resin or polymerizable monomer.

[Charge Control Agent]

The toner may contain a charge control agent. A known charge control agent may be used as this charge control agent. In particular, a charge control agent is preferred that provides a fast charging speed and that can stably maintain a certain amount of charge. When the toner is produced by a direct polymerization method, the charge control agent preferably has little ability to inhibit polymerization and preferably substantially lacks material soluble in aqueous media.

Charge control agents that control the toner to negative charging are exemplified by the following:

organometal compounds and chelate compounds such as monoazo metal compounds, acetylacetone/metal compounds, and metal compounds of, for example, aromatic oxycarboxylic acids, aromatic dicarboxylic acids, oxycarboxylic acids, and dicarboxylic acid. Also otherwise included are aromatic oxycarboxylic acids and aromatic mono- and polycarboxylic acids and their metal salts, anhydrides, and esters; also, phenol derivatives such as bisphenols. Additional examples are urea derivatives, metal-containing salicylic acid compounds, metal-containing naphthoic acid compounds, boron compounds, quaternary ammonium salts, and calixarene.

Charge control agents that control the toner to positive charging, on the other hand, are exemplified by the following:

nigrosine and nigrosine modifications such as the fatty acid metal salts; guanidine compounds; imidazole compounds; quaternary ammonium salts, e.g., tributylbenzylammonium-1-hydroxy-4-naphthosulfonate and tetrabutylammonium tetrafluoroborate, and onium salts, such as phosphonium salts, that are their analogs, and their lake pigments; triphenylmethane dyes and their lake pigments (the laking agent is exemplified by phosphotungstic acid, phosphomolybdic acid, phosphotungstomolybdic acid, tannic acid, lauric acid, gallic acid, ferricyanide, and ferrocyanide compounds); the metal salts of higher fatty acids; and resin-type charge control agents.

A single one of these charge control agents can be incorporated or two or more can be incorporated in combination.

The content of the charge control agent is preferably at least 0.01 mass parts and not more than 10.00 mass parts per 100.00 mass parts of the binder resin.

[External Additive]

The toner may be executed as a toner that does not incorporate an external additive, but in order to improve, for example, the flowability, charging performance, and cleaning performance, may incorporate, for example, a fluidizing agent, cleaning aid, and so forth as an external additive to a degree that does not impair the effects of the present invention.

The external additive can be exemplified by inorganic oxide fine particles such as silica fine particles, alumina fine particles, and titanium oxide fine particles; inorganic/stearic acid compound fine particles such as aluminum stearate fine particles and zinc stearate fine particles; and inorganic titanic acid compound fine particles such as strontium titanate and zinc titanate. A single one of these may be used by itself or a combination of two or more may be used.

In order to enhance the heat-resistant storability and enhance the environmental stability, the inorganic fine particle may be treated with, for example, a silane coupling agent, titanium coupling agent, higher fatty acid and silicone oil.

The BET specific surface area of the external additive is preferably at least 10 $m^2/g$ and not more than 450 $m^2/g$.

The BET specific surface area can be determined according to the BET method (preferably the BET multipoint method) using a cryogenic gas adsorption procedure based on a dynamic constant pressure procedure. For example, using a specific surface area analyzer (product name: Gemini 2375 Ver. 5.0, Shimadzu Corporation), the BET specific surface area ($m^2/g$) can be calculated by measurement carried out using the BET multipoint method and adsorption of nitrogen gas to the sample surface.

With regard to the amount of addition of these various external additives, their sum, per 100 mass parts of the particles prior to external addition, is preferably at least 0.05 mass parts and not more than 5 mass parts and more preferably at least 0.1 mass parts and not more than 3 mass parts. Combinations of the various external additives may be used as the external additive.

[Developer]

The toner may be used as a magnetic or nonmagnetic single-component developer, but may also be used mixed with a magnetic carrier as a two-component developer.

Magnetic particles comprising a known material, e.g., a metal such as iron, ferrite, or magnetite, or an alloy of these metals with a metal such as aluminum or lead, can be used as the magnetic carrier. Among these, the use of ferrite particles is preferred.

For example, a coated carrier as provided by coating the surface of a magnetic particle with a coating agent such as a resin, or a resin-dispersed carrier as provided by the dispersion of magnetic particles in a binder resin, may be used as the magnetic carrier.

The volume-average particle diameter of the magnetic carrier is preferably at least 15 μm and not more than 100 μm and is more preferably at least 25 μm and not more than 80 μm.

A known means can be used for the method of producing the toner under consideration. Examples here are the kneading/pulverization method and wet production methods.

Wet production methods are preferred from the standpoint of the ability to control the shape and provide a uniform toner particle diameter. The wet production methods can be exemplified by the suspension polymerization method, dissolution suspension method, emulsion polymerization and aggregation method, and emulsion aggregation method.

The suspension polymerization method is described in the following, but this does not imply a limitation thereto or thereby.

In the suspension polymerization method, the polymerizable monomer for forming the binder resin, the colorant, and other optional additives are dissolved or dispersed to uniformity using a disperser such as a ball mill or ultrasound disperser to prepare a polymerizable monomer composition (step of preparing a polymerizable monomer composition).

This other additive can be exemplified by multifunctional monomers, chain transfer agents, wax functioning as a release agent, charge control agents, plasticizers, and so forth.

The following polymerizable vinyl monomers are preferred examples of the polymerizable monomer:

styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; esters of methylene aliphatic monocarboxylic acids; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; as well as vinyl methyl ketone, vinyl hexyl ketone, and vinyl isopropyl ketone.

This polymerizable monomer composition is then introduced into a preliminarily prepared aqueous medium and droplets of the polymerizable monomer composition are formed, so as to provide the desired toner size, using a disperser or stirrer that generates a high shear force (granulation step).

The aqueous medium in the granulation step preferably contains a dispersion stabilizer in order to control the particle diameter of the toner, sharpen its particle size distribution, and suppress coalescence of the toner during the production process.

Dispersion stabilizers may be broadly classified into polymers, which generally develop a repulsive force through steric hindrance, and sparingly water-soluble inorganic compounds, which support dispersion stabilization through an electrostatic repulsive force. Fine particles of a sparingly water-soluble inorganic compound, because they are dissolved by acid or alkali, are preferably used because they can be easily removed after polymerization by dissolution by washing with acid or alkali.

A dispersion stabilizer containing magnesium, calcium, barium, zinc, aluminum, or phosphorus is preferably used for the sparingly water-soluble inorganic compound dispersion stabilizer. This dispersion stabilizer more preferably contains magnesium, calcium, aluminum, or phosphorus. Specific examples are as follows:

magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

An organic compound, for example, polyvinyl alcohol, gelatin, methyl cellulose, methylhydroxypropyl cellulose, ethyl cellulose, the sodium salt of carboxymethyl cellulose, or starch, may be co-used as the dispersion stabilizer.

The content of the dispersion stabilizer is preferably at least 0.01 mass parts and not more than 2.00 mass parts per 100 mass parts of the polymerizable monomer.

At least 0.001 mass % and not more than 0.1 mass % of a surfactant may be co-used in order to refine the dispersion stabilizer. In specific terms, a commercial nonionic, anionic, or cationic surfactant can be used. Examples are sodium dodecyl sulfate, sodium tetradecyl sulfate, sodium pentadecyl sulfate, sodium octyl sulfate, sodium oleate, sodium laurate, potassium stearate, and calcium oleate.

Either after the granulation step or while the granulation step is being carried out, the temperature may be set at approximately at least 50° C. and not more than 90° C. and the polymerizable monomer present in the polymerizable monomer composition may be polymerized to obtain a toner dispersion (polymerization step).

A stirring operation may be carried out during the polymerization step so as to provide a uniform temperature distribution within the vessel. When a polymerization initiator is added, this can be carried out for any time interval and at the required time. In addition, the temperature may be increased in the latter half of the polymerization reaction with the goal of obtaining a desired molecular weight distribution. In order to remove, e.g., unreacted polymerizable monomer and by-products, from the system, a portion of the aqueous medium may be distilled off by a distillation process either in the latter half of the reaction or after the completion of the reaction. The distillation process may be carried out at normal pressure or under reduced pressure.

An oil-soluble initiator is generally used as the polymerization initiator. Examples are as follows:

azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile, and peroxide-type initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A water-soluble initiator may be co-used as necessary for the polymerization initiator, and examples are as follows:

ammonium persulfate, potassium persulfate, 2,2'-azobis (N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrilesulfonate, ferrous sulfate, and hydrogen peroxide.

A single one of these polymerization initiators may be used or combinations of these polymerization initiators may be used, and, for example, a chain transfer agent and polymerization inhibitor may also be added and used in order to control the degree of polymerization of the polymerizable monomer.

The weight-average particle diameter of the toner is preferably at least 3.0 μm and not more than 10.0 μm from the standpoint of obtaining a high-definition and high-resolution image.

The weight-average particle diameter of the toner can be measured using the pore electrical resistance method. For example, the measurement can be performed using a "Coulter Counter Multisizer 3" (Beckman Coulter, Inc.).

The obtained toner dispersion is forwarded to a filtration step in which the toner and aqueous medium are subjected to solid-liquid separation.

This solid-liquid separation can be performed using a common filtration procedure.

This is preferably followed by washing using reslurrying and a water wash in order to remove foreign material that could not be removed from the toner surface.

After a thorough washing has been performed, another solid-liquid separation then yields a toner cake. After this, drying may be performed by a known drying means and as necessary particle populations having particle diameters other than the specified particle diameter may be separated by classification to obtain a toner.

When a surface layer having an organosilicon polymer is to be formed on the toner surface, a dispersion of the obtained toner may be used as the core particle dispersion and the surface layer may be formed by the addition of an organosilicon compound hydrolysis solution as described above.

<Method for Testing the Wettability with Respect to a Methanol/Water Mixed Solvent>

The wettability test with respect to a methanol/water mixed solvent is run on the toner by measurement using a "WET-100P" powder wettability tester (Rhesca Co., Ltd.) and the following conditions and procedure, and the determination is made from the obtained transmittance-versus-methanol dropwise addition curve.

A fluororesin-coated spindle-shaped stir bar having a length of 25 mm and a maximum barrel diameter of 8 mm is introduced into a cylindrical glass vessel having a diameter of 5 cm and a thickness of 1.75 mm.

60 mL of water that had been subjected to reverse osmosis (RO water) is introduced into this cylindrical glass vessel, and dispersion is performed for 5 minutes using an ultrasound disperser in order to remove air bubbles and so forth.

To this is added 0.1 g of the toner that had been exactly weighed out, to prepare the measurement sample liquid.

While stirring in the cylindrical glass vessel with the spindle-shaped stir bar at a rate of 300 rpm using a magnetic stirrer, methanol is continuously added at a dropwise addition rate of 0.8 mL/min through the powder wettability tester into the measurement sample liquid.

The transmittance of light at a wavelength of 780 nm is measured and a transmittance-versus-methanol dropwise addition curve is constructed as shown in FIG. 1. The methanol concentration (TA) when the transmittance is 50% is read from this transmittance-versus-methanol dropwise addition curve.

The methanol concentration (TA, volume %) is the value determined from (volume of methanol present in the cylindrical glass vessel/volume of the mixture of water and methanol present in the cylindrical glass vessel)×100.

<Method for Measuring the Interparticle Force>

The interparticle force is measured on the toner using an Aggrobot (Hosokawa Micron Corporation) and using the instructions provided with this instrument.

The specific measurement procedure and measurement conditions are as follows.

(Sample Conditions)

Mass of powder charged: 9.2 (g) for magnetic toner, 7.7 (g) for nonmagnetic toner Binder mass: 0 (g)

True density of the powder: true density of the toner ($kg/m^3$)

Density of the liquid binder: 0 ($kg/m^3$)

Volume-surface average diameter of the powder: weight-average particle diameter (D4) of the toner (μm)

Specific surface shape factor: 6 (−)

Minimum void ratio for the dry powder: 0.26 (−)

(Measurement Conditions)

Environment temperature: 25° C.

Humidity: 50%

Cell interior diameter: 25 mm

Cell interior height: 37.5 mm

Cell temperature: 25° C.

Spring wire diameter: 1.0 mm

Compression rate: 1.0 mm/sec

Compression hold time: 0.0 sec

Compressive stress: 8 $kg/cm^2$

Tensile rate: 0.40 mm/sec

Tensile sampling start time: 0.0 sec

Tensile sampling time: 25 sec (1) For Magnetic Toners

Figure 2A:
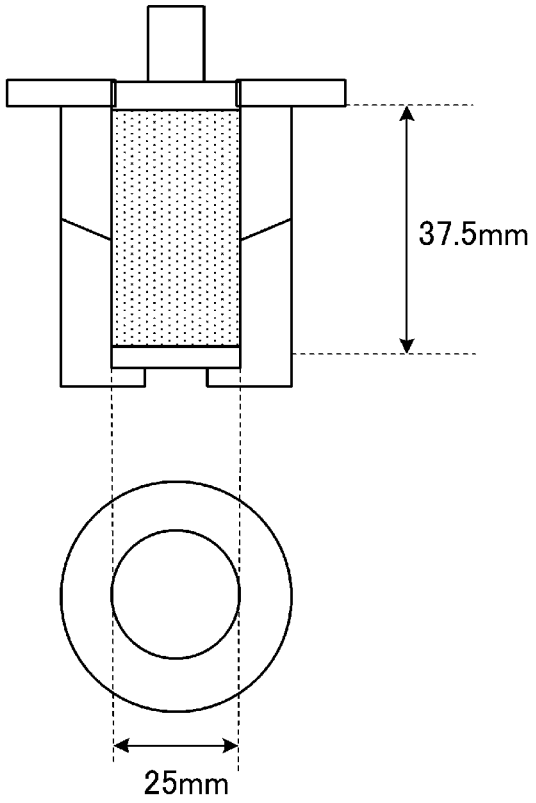
FIG. 2A is a diagram showing an example of an apparatus used in the measurement of the interparticle force.

Operating in a 25° C./50% environment, 9.2 g of the toner is filled into the vertically separable cylindrical cell shown in FIG. 2A. The compression bar is then lowered at 1.0 mm/sec to apply a perpendicular load of 78.5 N and form a toner consolidation.

Figure 2B:
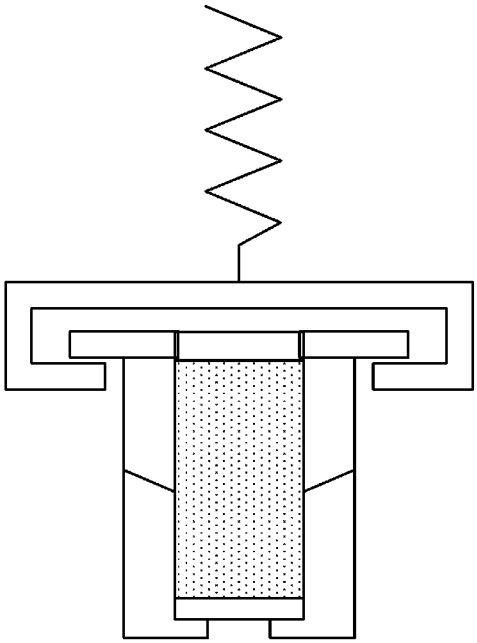
FIG. 2B is a diagram showing an example of an apparatus used in the measurement of the interparticle force.

Then, as shown in FIG. 2B, the toner consolidation is tensed by lifting up the upper cell section at a rate of 0.40 mm/sec, and the interparticle force (nN) is calculated from the maximum tensile rupture strength obtained when the toner consolidation is ruptured. The interparticle force (nN) is calculated automatically.

(2) For Nonmagnetic Toners

Operating in a 25° C./50% environment, 7.7 g of the toner is filled into the vertically separable cylindrical cell shown in FIG. 2A. The compression bar is then lowered at 1.0 mm/sec to apply a perpendicular load of 78.5 N and form a toner consolidation.

Then, as shown in FIG. 2B, the toner consolidation is tensed by lifting up the upper cell section at a rate of 0.40 mm/sec, and the interparticle force (nN) is calculated from the maximum tensile rupture strength obtained when the toner consolidation is ruptured. The interparticle force (nN) is calculated automatically.

<Method for Measuring the Content of the Organosilicon Polymer>

The content of the organosilicon polymer in the toner is measured using an "Axios" wavelength-dispersive x-ray fluorescence analyzer (Malvern Panalytical B.V.) and the "SuperQ ver. 4.0F" (Malvern Panalytical B.V.) specialized software provided with the instrument in order to set the measurement conditions and analyze the measurement data.

Rh is used for the x-ray tube anode; a vacuum is used for the measurement atmosphere; the measurement diameter (collimator mask diameter) is 27 mm; and the measurement time is 10 seconds.

Detection is carried out with a proportional counter (PC) in the case of measurement of the light elements, and with a scintillation counter (SC) in the case of measurement of the heavy elements.

4 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

0.5 mass parts of silica ($SiO_2$) fine powder is added to 100 mass parts of the toner lacking the organosilicon polymer (toner without external additive addition is used), and thorough mixing is performed using a coffee mill. 5.0 mass parts and 10.0 mass parts of the silica fine powder are each likewise mixed with the toner, and these are used as samples for construction of a calibration curve.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using PET for the analyzer crystal.

In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis.

The toner to be analyzed is then made into a pellet proceeding as above using the tablet compression molder and is subjected to measurement of its Si-Kα radiation count rate. The content of the organosilicon polymer in the toner is determined from the aforementioned calibration curve.

<Method for Confirming the Structure Represented by the Formula ($R^aT3$)>

Of structures represented by the formula ($R^aT3$), the structures with, for example, a hydrocarbon group bonded to the silicon atom are confirmed by $^{13}C$-NMR (solid state).

The detailed structure of the formula ($R^aT3$) is confirmed by $^{13}C$-NMR (solid state) and $^{29}Si$-NMR.

The instrument used, the measurement conditions, and the method of sample preparation are given in the following.

"Measurement Conditions in $^{13}C$-NMR (Solid State)"

Instrument: JNM-ECX500II, Jeol Resonance Inc.

Sample tube: 3.2 mmØ

Sample: tetrahydrofuran-insoluble matter of the toner for NMR measurement, 150 mg Measurement temperature: room temperature Pulse mode: CP/MAS Measurement nucleus frequency: 123.25 MHz ($^{13}C$)

Reference substance: adamantane (external reference: 29.5 ppm)

Sample spinning rate: 20 kHz

Contact time: 2 ms

Delay time: 2 s

Number of accumulations: 1024

"Sample Preparation Procedure"

Measurement sample preparation: 10.0 g of the toner is exactly weighed out and is introduced into an extraction thimble (No. 86R, Toyo Roshi Kaisha, Ltd.), and this is placed in a Soxhlet extractor. Extraction is performed for 20 hours using 200 mL of tetrahydrofuran as the solvent, and the residue in the extraction thimble is vacuum dried for several hours at 40° C. to provide the sample for NMR measurement.

In the case of toner to which, for example, external additive has been added, the toner is obtained by removal of this external additive using the following procedure.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL) for swing rotor, and separation is performed in a centrifugal separator using conditions of 3500 rpm and 30 minutes.

The toner is separated from the detached external additive by this process. Satisfactory separation of the toner from the aqueous solution is checked visually, and the toner separated into the uppermost layer is recovered with, for example, a spatula. The recovered toner is filtered on a vacuum filter and then dried for at least 1 hour in a drier to yield the toner. This process is carried out a plurality of times to secure the required amount.

When $R^a$ in formula ($R^aT3$) is a structure represented by formula (i), the presence of the structure represented by formula (i) is checked through the presence/absence of a signal originating with the silicon atom-bonded methine group (>CH—Si).

When $R^a$ in formula ($R^aT3$) is a structure represented by formula (ii), the presence of the structure represented by formula (ii) is checked through the presence/absence of a signal originating with, for example, a silicon atom-bonded arylene group (for example, the phenylene group (Si—$C_6H_4$—)) or alkylene group, for example, the methylene group (Si—$CH_2$—) or ethylene group (Si—$C_2H_4$—).

When $R^a$ in formula ($R^aT3$) is a hydrocarbon group having at least 1 and not more than 6 carbons, its presence is checked through the presence/absence of a signal originating with, for example, a silicon atom-bonded methyl group (Si—$CH_3$), ethyl group (Si—$C_2H_5$), propyl group (Si—$C_3H_7$), butyl group (Si—$C_4H_9$), pentyl group (Si—$C_5H_{11}$), hexyl group (Si—$C_6H_{13}$), or phenyl group (Si—$C_6H_5$).

<Method for Measuring the Peak Area Assigned to the Formula ($R^aT3$) Structure and Measured by $^{29}Si$-NMR on the Tetrahydrofuran-Insoluble Matter of the Toner>

$^{29}$Si-NMR (solid state) measurement on the tetrahydrofuran-insoluble matter in the toner is carried out using the following measurement conditions.

"Measurement Conditions in $^{29}$Si-NMR (Solid State)"
Instrument: JNM-ECX500II, Jeol Resonance Inc.
Sample tube: 3.2 mmØ
Sample: tetrahydrofuran-insoluble matter of the toner for NMR measurement, 150 mg
Measurement temperature: room temperature
Pulse mode: CP/MAS
Measurement nucleus frequency: 97.38 MHz ($^{29}$Si)
Reference substance: DSS (external reference: 1.534 ppm)
Sample spinning rate: 10 kHz
Contact time: 10 ms
Delay time: 2 s
Number of accumulations: 2000 to 8000

After this measurement, peak separation is performed into the following structure X1, structure X2, structure X3, and structure X4 by curve fitting for a plurality of silane components having different substituents and bonding groups, for the tetrahydrofuran-insoluble matter of the toner, and their respective peak areas are calculated.

Structure X1: $(Ri)(Rj)(Rk)SiO_{1/2}$ formula (12)

Structure X2: $(Rg)(Rh)Si(O_{1/2})_2$ formula (13)

Structure X3: $RmSi(O_{1/2})_3$ formula (14)

Structure X4: $Si(O_{1/2})_4$ formula (15)

Structure X1:

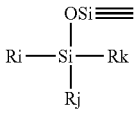

(12)

Structure X2:

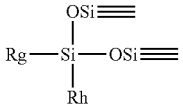

(13)

Structure X3:

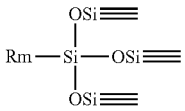

(14)

Structure X4:

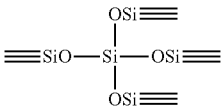

(15)

[The Ri, Rj, Rk, Rg, Rh, and Rm in formulas (12), (13), and (14) represent silicon atom-bonded organic groups, e.g., hydrocarbon groups having at least 1 and not more than 6 carbons, a halogen atom, hydroxy group, acetoxy group, or alkoxy group.]

In the chart obtained by $^{29}$Si-NMR measurement on the tetrahydrofuran-insoluble matter of the toner, the plurality of silane components having different substituents and bonding groups in the structure X3 are characterized using the chemical shift values.

The peak areas are determined by performing peak separation on these by curve fitting so as to minimize the differences between the synthetic peaks and measurement results.

Using this procedure, the percentage for the peak area assigned to the formula ($R^{\alpha}T3$) structure is calculated with reference to the total peak area for the organosilicon polymer.

<Method for Calculating the Fixing Ratio of the Organosilicon Polymer to the Toner>

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume) to prepare a dispersion. 1 g of the toner is added to this dispersion, and clumps of the toner are broken up using, for example, a spatula.

A water wash is performed by shaking the centrifugal separation tube with a shaker for 20 minutes at 350 strokes per minute (spm).

After shaking, the solution is transferred over to a glass tube (50 mL) for swing rotor, and separation is performed with a centrifugal separator (H-9R, Kokusan Co., Ltd.) using conditions of 3500 rpm and 30 minutes.

Satisfactory separation of the toner from the aqueous solution is checked visually, and the toner separated into the uppermost layer is recovered with, for example, a spatula. The aqueous solution containing the recovered toner is filtered on a vacuum filter and then dried for at least 1 hour in a drier to yield the toner.

The dried product is crushed with a spatula and the amount of the organosilicon polymer is measured by x-ray fluorescence. The fixing ratio (%) is calculated from the ratio for the amount of the measured element between the post-water-wash toner and the starting toner.

Measurement of the x-ray fluorescence of the particular element is based on JIS K 0119-1969 and is specifically as follows.

An "Axios" wavelength-dispersive x-ray fluorescence analyzer (Malvern Panalytical B.V.) is used as the measurement instrumentation, and the "SuperQ ver. 4.0F" (Malvern Panalytical B.V.) software provided with the instrument is used in order to set the measurement conditions and analyze the measurement data.

Rh is used for the x-ray tube anode; a vacuum is used for the measurement atmosphere; the measurement diameter (collimator mask diameter) is 10 mm; and the measurement time is 10 seconds. Detection is carried out with a proportional counter (PC) in the case of measurement of the light elements, and with a scintillation counter (SC) in the case of measurement of the heavy elements.

Approximately 1 g of the post-water-wash toner or starting toner is introduced into a specialized aluminum compaction ring having a diameter of 10 mm and is smoothed over, and, using a "BRE-32" tablet compression molder (Maekawa Testing Machine Mfg. Co., Ltd.), a pellet is produced by molding to a thickness of approximately 2 mm by compressing for 60 seconds at 20 MPa, and this pellet is used as the measurement sample.

The measurement is carried out using these conditions and element identification is performed based on the obtained x-ray peak positions, and their concentration is calculated from the count rate (unit: cps), which is the number of x-ray photons per unit time.

To quantitate the amount of silicon in the toner, for example, 0.5 mass parts of silica ($SiO_2$) fine powder is added to 100 mass parts of the toner and thorough mixing is performed using a coffee mill. 2.0 mass parts and 5.0 mass parts of the silica fine powder are each likewise mixed with the toner, and these are used as samples for calibration curve construction.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using PET for the analyzer crystal. In this case, the acceleration voltage and current value for the x-ray generator are, respectively, 24 kV and 100 mA. A calibration curve in the form of a linear function is obtained by placing the obtained x-ray count rate on the vertical axis and the amount of $SiO_2$ addition to each calibration curve sample on the horizontal axis.

The toner to be analyzed is then made into a pellet proceeding as above using the tablet compression molder and is subjected to measurement of its Si—Kα radiation count rate. The content of the organosilicon polymer in the toner is determined from the aforementioned calibration curve. The ratio of the amount of the element in the post-water-wash toner to the amount of the element in the starting toner calculated by this method is determined and is used as the fixing ratio (%) to the toner.

<Method for Measuring the Weight-Average Particle Diameter (D4) of the Toner>

The weight-average particle diameter (D4) of the toner is determined proceeding as follows. The measurement instrument used is a "Coulter Counter Multisizer 3" (registered trademark, Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass %, and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) An "Ultrasonic Dispersion System Tetora 150" (Nikkaki Bios Co., Ltd.) is prepared; this is an ultrasonic disperser with an electrical output of 120 W and is equipped with two oscillators (oscillation frequency=50 kHz) disposed such that the phases are displaced by 180°. Approximately 3.3 L of deionized water is introduced into the water tank of this ultrasonic disperser and approximately 2 mL of Contaminon N is added to this water tank.

(4) The beaker described in (2) is set into the beaker holder opening on the ultrasonic disperser and the ultrasonic disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasonic, approximately 10 mg of the toner is added to the aqueous electrolyte solution in small aliquots and dispersion is carried out. The ultrasonic dispersion treatment is continued for an additional 60 seconds. The water temperature in the water tank is controlled as appropriate during ultrasonic dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method for Measuring the True Density of the Toner>

The true density of the toner is measured using an AccuPyc II 1340 series automatic dry pycnometer (Shimadzu Corporation). The measurement is carried out using 10 mL for the cell size and 5.0 g for the mass of the toner.

EXAMPLES

The present invention is specifically described herebelow using examples and comparative examples, but the present invention is not limited thereto or thereby. Unless specifically indicated otherwise, "parts" and "%" for each of the materials in the examples and comparative examples is on a mass basis in all instances.

Example 1

(Aqueous Medium 1 Preparation Step)

14.0 parts of sodium phosphate (dodecahydrate, RASA Industries, Ltd.) was introduced into 1000.0 parts of deionized water in a reaction vessel, and the temperature was maintained for 1.0 hour at 65° C. while purging with nitrogen.

While stirring at 12,000 rpm using a T. K. Homomixer (Tokushu Kika Kogyo Co., Ltd.), an aqueous calcium chloride solution of 9.2 parts of calcium chloride (dihydrate) dissolved in 10.0 parts of deionized water was added all at once to prepare an aqueous medium containing a dispersion stabilizer. 10 mass % hydrochloric acid was introduced into the aqueous medium to adjust the pH to 6.0, thereby yielding aqueous medium 1.

(Polymerizable Monomer Composition Preparation Step)

Styrene: 60.0 parts

C. I. Pigment Blue 15:3: 6.5 parts

These materials were introduced into an attritor (Mitsui Miike Chemical Engineering Machinery Co., Ltd.), and a pigment dispersion was prepared by dispersing for 5.0 hours at 220 rpm using zirconia particles having a diameter of 1.7 mm.

The following materials were added to this pigment dispersion.

Styrene: 15.0 parts

N-butyl acrylate: 25.0 parts

Divinylbenzene (crosslinking agent): 0.3 parts

Saturated polyester resin: 4.0 parts (polycondensate (molar ratio=10:12) of propylene oxide-modified bisphenol A (2 mol adduct) and terephthalic acid, glass transition temperature (Tg)=68° C., weight-average molecular weight (Mw)=10,000, molecular weight distribution (Mw/Mn)=5.12)

Fischer-Tropsch wax (melting point=78° C.): 9.0 parts

These were held at 65° C. and dissolution and dispersion to homogeneity were carried out at 500 rpm using a T. K. Homomixer (Tokushu Kika Kogyo Co., Ltd.) to prepare a polymerizable monomer composition.

(Step of Hydrolyzing the Organosilicon Compound for the Surface Layer)

60.0 parts of deionized water was metered into a reaction vessel equipped with a stirrer and thermometer and the pH was adjusted to 3.0 using 10 mass % hydrochloric acid. The temperature of this was brought to 70° C. by heating while stirring.

This was followed by the addition of 40.0 parts of methyltriethoxysilane and stirring for 2 hours to carry out hydrolysis of the organosilicon compound for the surface layer. The end point for the hydrolysis was confirmed visually when oil-water separation was absent and a single layer was assumed; cooling then yielded a hydrolysis solution 1 of the organosilicon compound for the surface layer.

(Granulation Step)

While holding the temperature of the aqueous medium 1 at 70° C. and holding the rotation rate of the T. K. Homomixer at 12,000 rpm, the polymerizable monomer composition was introduced into the aqueous medium 1 and 9.0 parts of the polymerization initiator t-butyl peroxypivalate was added. This was granulated in this state for 10 minutes while maintaining the stirring device at 12,000 rpm.

(Polymerization Step)

After the granulation step, the stirrer was changed over to a propeller stirring blade, and a polymerization was run for 5.0 hours while maintaining 70° C. while stirring at 150 rpm. A polymerization reaction was then run by raising the temperature to 95° C. and heating for 2.0 hours, to obtain a slurry of core particles.

After this, the temperature of the slurry was cooled to 60° C., and measurement of the pH gave pH=5.0. While continuing to stir at 60° C., 20.0 parts of the hydrolysis solution 1 of the organosilicon compound for the surface layer was added to start formation of the surface layer on the toner. The surface layer was formed by maintenance in this state for 30 minutes; adjusting the pH of the slurry, using an aqueous sodium hydroxide solution, to 9.0 to end the condensation; and holding for an additional 300 minutes.

(Washing and Drying Step)

After the completion of the polymerization step, the obtained toner slurry was cooled; hydrochloric acid was added to the toner slurry to adjust the pH to 1.5 or below; holding was carried out for 1 hour while stirring; and solid-liquid separation was performed using a pressure filter to obtain a toner cake.

This was reslurried with deionized water to provide another dispersion, after which solid-liquid separation was performed with the aforementioned filter. Reslurrying and solid-liquid separation were repeated until the electrical conductivity of the filtrate reached not more than 5.0 μS/cm, and a toner cake was obtained by the final solid-liquid separation.

The obtained toner cake was dried using a Flash Jet Dryer air current dryer (Seishin Enterprise Co., Ltd.), and the fines and coarse powder were cut using a Coanda effect-based multi-grade classifier to obtain toner 1.

The drying conditions were an injection temperature of 90° C. and a dryer outlet temperature of 40° C., and the toner cake feed rate was adjusted in conformity to the moisture content of the toner cake to a rate at which the outlet temperature did not deviate from 40° C.

In the present example, the obtained toner 1 was used without being added with an external additive.

It was confirmed by the methods indicated above that toner 1 had a surface layer containing an organosilicon polymer. The properties of the obtained toner 1 are given in Table 2. The methods used to evaluate toner 1 are described in the following. The results are given in Table 3.

<Evaluation of the Developing Performance of the Toner Using a Laser Printer>

A modified "LBP7600C" commercial laser printer from Canon Inc. was used.

The modification involved changing the gearing and software in the main unit of the machine used for evaluation to set the rotation rate of the developing roller such that it rotated at twice the peripheral velocity of the drum. 40 g of the toner was filled into a toner cartridge of the LBP7600C.

(1) Evaluations in a Low-Temperature, Low-Humidity Environment (Solid Image Compliance Performance, Control Defects, Development Streaks)

Five prints of a full-solid image were output on letter-size XEROX 4200 paper (75 g/m$^2$, Xerox Corporation) in a low-temperature, low-humidity environment (15° C./10% RH) (initial evaluation).

One print of a halftone image was also output (initial evaluation).

After this, 5000 prints of an image with a print percentage of 1% were output.

Five prints of the full-solid image (evaluation post-durability test) and one print of the halftone image (evaluation post-durability test) were subsequently similarly output.

An evaluation of the solid image compliance performance, control defects, and development streaks was performed on the obtained full-solid image and halftone image.

The image density was measured using an "RD918 MacBeth reflection densitometer" (MacBeth Corporation) in accordance with the instruction manual provided therewith. The image density was measured by measuring the relative density versus the image in a white background area having an image density of 0.00, and the obtained relative density was used as the image density value.

[Evaluation Criteria]

(Solid Image Compliance Performance) The difference between the image density at the front edge of the first full-solid image print and the image density at the rear edge of the third full-solid image print was evaluated.

A: the image density difference is less than 0.10

B: the image density difference is at least 0.10 and less than 0.20

C: the image density difference is at least 0.20 and less than 0.30

D: the image density difference is at least 0.30

(Control Defects)

The evaluation was performed based on the amount of toner clumps and spotty streaks seen in the halftone image.

A: No occurrence.

B: No spotty streaks are present, but small toner clumps are present at two or three locations.

C: There is moderate spotty streaking at the end, or small toner clumps are present at four or five locations.

D: Spotty streaking is present over the entire surface, or small toner clumps are present at at least five locations or obvious toner clumps are present.

(Development Streaks)

The number of vertical streaks observed on the developing roller and on the halftone image was evaluated.

A: Vertical streaks in the paper output direction are not seen on the developing roller or on the image.

B: Not more than 5 fine streaks are seen in the circumferential direction at the two ends of the developing roller. Or, only minor vertical streaking in the paper output direction is seen on the image.

C: At least six and not more than 20 fine streaks are seen in the circumferential direction at the two ends of the developing roller. Or, a number of fine streaks are seen on the image.

D: At least 21 fine streaks are seen in the circumferential direction at the two ends of the developing roller. Or, severe streaking is seen on the image.

(2) Evaluations in a High-Temperature, High-Humidity Environment (Solid Image Compliance Performance, Fogging, Development Streaks)

The toner-filled process cartridge was held for three days in a high-temperature, high-humidity environment (35° C./80% RH). After this, one print of a solid white image having a print percentage of 0% (initial evaluation) and five prints of a full-solid image (initial evaluation) were output on Canon Color Laser Copy Paper (A4: 81.4 g/m$^2$, Canon Inc.).

One print of a halftone image was also output (initial evaluation).

After this, 5000 prints of an image with a print percentage of 1% were output.

After this, one print of the solid white image (evaluation post-durability test), five prints of the full-solid image (evaluation post-durability test), and one print of the halftone image (evaluation post-durability test) were similarly output.

Using the same criteria as for the evaluations in a low-temperature, low-humidity environment, the solid image compliance performance and development streaks were evaluated on the obtained full-solid image and halftone image.

An evaluation of fogging was performed on the obtained solid white image.

The fogging density (%) was measured using a "Reflectometer Model TC-6DS" (Tokyo Denshoku Co., Ltd.), and the fogging density (%) was calculated from the difference between the brightness of a white background region in the measured image and the brightness of the transfer paper. An amber filter was used for the filter.

(Evaluation Criteria)

A: the fogging density is less than 0.5%

B: the fogging density is at least 0.5% and less than 1.0%

C: the fogging density is at least 1.0% and less than 2.0%

D: the fogging density is at least 2.0%

(3) Evaluation of Charge Rising

The toner-filled process cartridge was held for three days in a high-temperature, high-humidity environment (35° C./80% RH). 15 prints of an image are then output. The machine is forcibly halted during the output of the 15th print, and the amount of toner charge on the developing roller immediately after passage past the regulating blade is measured.

Figure 3:
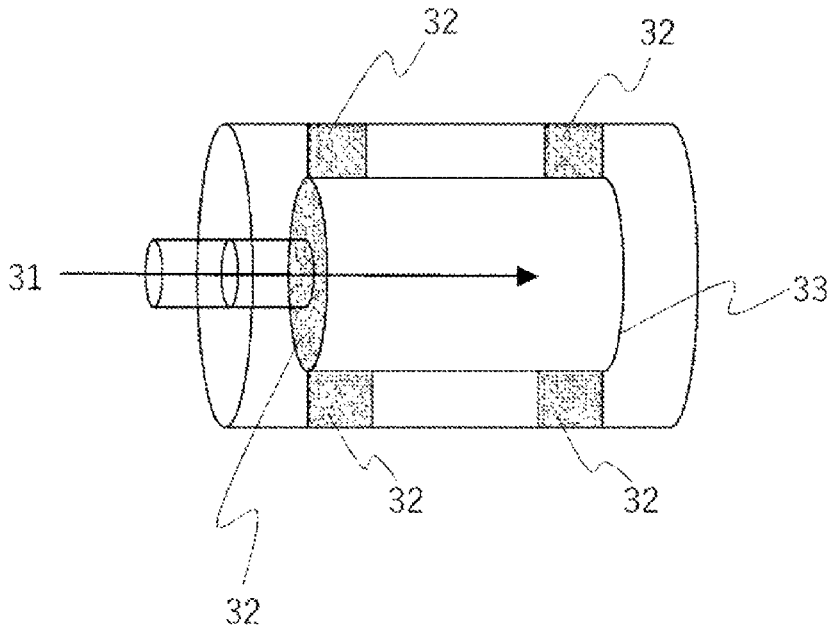
FIG. 3 is a diagram showing an example of a tool used in measurement of the amount of charge on a developing roller.

The amount of charge on the developing roller was measured using the Faraday cage shown in FIG. 3.

The toner on the developing roller was suctioned in by placing the interior (right side in the figure) under reduced pressure, and the toner was collected by the disposition of a toner filter 33 (31 refers to the suction zone and 32 refers to a holder).

Using the mass (M) of the collected toner and the charge (Q) directly measured with a Coulombmeter, the amount of charge per unit mass Q/M (μC/g) was calculated and was taken to be the amount of toner charge (Q/M), and this was rank scored as follows.

A: less than −40 μC/g

B: at least −40 μC/g and less than −30 μC/g

C: at least −30 μC/g and less than −25 μC/g

D: at least −25 μC/g and less than −20 μC/g

E: at least −20 μC/g

Examples 2 to 14 and Comparative Example 4

Toners 2 to 14 and toner 18 were produced by the same method as in Example 1, but changing, as shown in Table 1, the type of organosilicon compound used in the "Step of Hydrolyzing the Organosilicon Compound for the Surface Layer" in Example 1 and the conditions in the addition of the hydrolysis solution 1 in the "Polymerization Step".

That the obtained toner had an organosilicon polymer-containing surface layer was confirmed by the method described above. The properties of the obtained toners are given in Table 2, and the results of their evaluations are given in Table 3.

Comparative Example 1

The "Step of Hydrolyzing the Organosilicon Compound for the Surface Layer" in Example 1 was not performed; rather, 15 parts of the methyltriethoxysilane as the organosilicon compound for the surface layer was added as such as monomer in the "Polymerizable Monomer Composition Preparation Step".

In addition, in the "Polymerization Step", after the core particle slurry had been obtained, the addition of the hydrolysis solution was not done, and only the pH adjustment and subsequent holding were performed.

Except for the preceding, the toner 15 was produced by the same method as in Example 1.

That the obtained toner had an organosilicon polymer-containing surface layer was confirmed by the method described above. The properties of the obtained toner are given in Table 2, and the results of its evaluations are given in Table 3.

Comparative Example 2

The "Step of Hydrolyzing the Organosilicon Compound for the Surface Layer" in Example 1 was not performed; rather, 8 parts of the methyltriethoxysilane as the organosilicon compound for the surface layer was added as such as monomer in the "Polymerizable Monomer Composition Preparation Step".

In addition, in the "Polymerization Step", after the core particle slurry had been obtained, the addition of the hydrolysis solution was not done, and only the pH adjustment and subsequent holding were performed.

Except for the preceding, the toner 16 was produced by the same method as in Example 1.

That the obtained toner had an organosilicon polymer-containing surface layer was confirmed by the method described above. The properties of the obtained toner are given in Table 2, and the results of its evaluations are given in Table 3.

Comparative Example 3

The "Step of Hydrolyzing the Organosilicon Compound for the Surface Layer" in Example 1 was not performed.

In addition, in the "Polymerization Step", after the core particle slurry had been obtained, the addition of the hydrolysis solution was not done, and only the pH adjustment and subsequent holding were performed.

Except for the preceding, toner 17 (pre-addition of external additive) was produced by the same method as in Example 1.

Using a Mitsui HENSCHEL MIXER (Mitsui Miike Chemical Engineering Machinery Co., Ltd.), toner 17 was prepared by mixing 2.0 parts of untreated silica fine particles that had been synthesized by a dry method (product name: Aerosil #200, specific surface area of approximately 200 $m^2/g$, Nippon Aerosil Co., Ltd.) for 15 minutes at 3000 rpm with 100.0 parts of the aforementioned toner 17 (pre-addition of external additive). The properties of the obtained toner are given in Table 2, and the results of its evaluations are given in Table 3.

Comparative Example 5

Toner 19 was obtained by mixing 100.0 parts of the toner 17 (pre-addition of external additive) prepared in Comparative Example 3 with 2.0 parts of hydrophobic silica fine particles for 15 minutes at 3000 rpm using a Mitsui HENSCHEL MIXER (Mitsui Miike Chemical Engineering Machinery Co., Ltd.).

The hydrophobic silica fine particles, which functioned as a flowability improver, had been treated with a dimethylsilicone oil (20 mass %) and had a BET specific surface area of 170 $m^2/g$.

The properties of the obtained toner are given in Table 2, and the results of its evaluations are given in Table 3.

Comparative Example 6

Toner 20 was obtained by mixing 100.0 parts of the toner 17 (pre-addition of external additive) prepared in Comparative Example 3 with 2.0 parts of hydrophobic silica fine particles for 15 minutes at 3000 rpm using a Mitsui HENSCHEL MIXER (Mitsui Miike Chemical Engineering Machinery Co., Ltd.).

The hydrophobic silica fine particles, which functioned as a flowability improver, had been treated with a dimethylsilicone oil (20 mass %) and had a BET specific surface area of 50 $m^2/g$.

The properties of the obtained toner are given in Table 2, and the results of its evaluations are given in Table 3.

TABLE 1

| | Type of organosilicon compound for the surface layer | Conditions for addition of hydrolysis solution 1 | | |
|---|---|---|---|---|
| | | Slurry pH | Slurry temperature (° C.) | Number of parts of addition of hydrolysis solution 1 |
| Example 1 | Methyltriethoxysilane | 5.0 | 60 | 20.0 |
| Example 2 | Methyltriethoxysilane | 5.0 | 70 | 20.0 |
| Example 3 | Methyltriethoxysilane | 5.0 | 90 | 20.0 |
| Example 4 | Methyltriethoxysilane | 5.0 | 40 | 20.0 |
| Example 5 | Methyltriethoxysilane | 9.0 | 60 | 20.0 |
| Example 6 | Methyltriethoxysilane | 5.0 | 60 | 10.0 |
| Example 7 | Methyltriethoxysilane | 5.0 | 60 | 37.5 |
| Example 8 | Methyltriethoxysilane | 5.0 | 60 | 50.0 |
| Example 9 | Methyltriethoxysilane | 5.0 | 60 | 7.5 |
| Example 10 | N-propyltriethoxysilane | 5.0 | 60 | 20.0 |
| Example 11 | Phenyltriethoxysilane | 5.0 | 60 | 20.0 |
| Example 12 | Hexyltriethoxysilane | 5.0 | 60 | 20.0 |
| Example 13 | Vinyltriethoxysilane | 5.0 | 60 | 20.0 |
| Example 14 | Allyltriethoxysilane | 5.0 | 60 | 20.0 |
| Comparative Example 1 | Methyltriethoxysilane | Added without hydrolysis as monomer in the "Step of Preparing a Polymerizable Monomer Composition" | | |
| Comparative Example 2 | Methyltriethoxysilane | | | |
| Comparative Example 3 | Described in paragraph [0070] | | | |
| Comparative Example 4 | Methyltriethoxysilane | 5.0 | 25 | 20.0 |
| Comparative Example 5 | Described in paragraph [0071] | | | |
| Comparative Example 6 | Described in paragraph [0072] | | | |

TABLE 2

| | Toner No. | Methanol concentration (volume %) | Inter-particle force (nN) | Content of organosilicon polymer (mass %) | Fixing ratio of organosilicon polymer (%) |
|---|---|---|---|---|---|
| Example 1 | 1 | 10.5 | 5.1 | 2.3 | 93.2 |
| Example 2 | 2 | 18.8 | 15.2 | 2.1 | 96.1 |
| Example 3 | 3 | 28.6 | 20.5 | 2.2 | 98.3 |
| Example 4 | 4 | 7.0 | 23.6 | 2.0 | 88.5 |
| Example 5 | 5 | 27.5 | 3.2 | 2.1 | 92.6 |
| Example 6 | 6 | 16.0 | 21.0 | 0.6 | 94.4 |

TABLE 2-continued

| | Toner No. | Methanol concentration (volume %) | Interparticle force (nN) | Content of organosilicon polymer (mass %) | Fixing ratio of organosilicon polymer (%) |
|---|---|---|---|---|---|
| Example 7 | 7 | 8.6 | 3.3 | 4.9 | 91.5 |
| Example 8 | 8 | 7.5 | 1.6 | 7.2 | 90.2 |
| Example 9 | 9 | 19.6 | 23.9 | 0.4 | 94.6 |
| Example 10 | 10 | 14.3 | 8.5 | 2.1 | 93.2 |
| Example 11 | 11 | 17.5 | 12.3 | 2.2 | 92.1 |
| Example 12 | 12 | 18.2 | 14.7 | 2.2 | 92.5 |
| Example 13 | 13 | 18.5 | 16.3 | 2.3 | 98.5 |
| Example 14 | 14 | 18.8 | 17.2 | 2.1 | 98.6 |
| Comparative Example 1 | 15 | 23.2 | 31.5 | 4.2 | 85.1 |
| Comparative Example 2 | 16 | 25.6 | 38.2 | 1.4 | 86.2 |
| Comparative Example 3 | 17 | 5.2 | 45.1 | — | — |
| Comparative Example 4 | 18 | 4.0 | 22.3 | 1.8 | 84.6 |
| Comparative Example 5 | 19 | 39.8 | 23.6 | — | — |
| Comparative Example 6 | 20 | 51.1 | 35.4 | — | — |

This application claims the benefit of Japanese Patent Application No. 2017-096504, filed, May 15, 2017, Japanese Patent Application No. 2017-096534, filed, May 15, 2017, and Japanese Patent Application No. 2017-096544, filed, May 15, 2017, which are hereby incorporated by reference herein in their entirety.

What is claimed is:

1. A toner, comprising:

a toner core particle comprising a colorant and a binder resin; and a surface layer containing an organosilicon polymer, the surface layer being on the toner core particle, wherein a fixing ratio of the organosilicon polymer to the core particle is 90.0 to 100.0%, in a wettability test of the toner with respect to a methanol/water mixed solvent, a methanol concentration at a time when a transmittance of light at a wavelength of 780 nm is 50% is 5.0 to 30.0 volume %, and an interparticle force measured by rupturing a consolidation of the toner formed by compressing the toner with a load of 78.5 N is 1.0 to 25.0 nN.

2. The toner according to claim 1, wherein the methanol concentration in the wettability test is 5.0 to 20.0 volume %.

TABLE 3

| | | Evaluations in a low-temperature, low-humidity environment | | | | | | | | Evaluations in a high-temperature, high-humidity environment | | | | | | | | | |
|---|---|---|---|---|---|---|---|---|---|---|---|---|---|---|---|---|---|---|---|
| | | Solid image compliance performance | | | | Control defects | | Development streaks | | Solid image compliance performance | | | | Fogging | | | | Development streaks | | |
| | Toner No. | Initial | | Post-durability test | | Initial | Post-durability test | Post-durability test | | Initial | | Post-durability test | | Initial | | Post-durability test | | Post-durability test | | Charge rising (μC/g) |
| Example 1 | 1 | A | 0.02 | A | 0.03 | A | A | A | 0 | A | 0.03 | A | 0.04 | A | 0.1% | A | 0.1% | A | 0 | A −46 |
| Example 2 | 2 | A | 0.05 | A | 0.05 | A | A | A | 0 | A | 0.04 | A | 0.05 | A | 0.2% | A | 0.2% | A | 0 | A −44 |
| Example 3 | 3 | A | 0.06 | C | 0.23 | A | B | A | 0 | A | 0.06 | B | 0.11 | A | 0.1% | A | 0.1% | A | 0 | A −44 |
| Example 4 | 4 | A | 0.06 | A | 0.06 | A | C | B | 3 | A | 0.06 | B | 0.14 | A | 0.4% | A | 0.4% | B | 4 | A −45 |
| Example 5 | 5 | A | 0.06 | C | 0.21 | A | A | A | 0 | A | 0.07 | A | 0.08 | A | 0.3% | A | 0.4% | A | 0 | A −46 |
| Example 6 | 6 | A | 0.04 | A | 0.07 | A | B | A | 0 | A | 0.05 | B | 0.12 | A | 0.4% | A | 0.4% | A | 0 | A −44 |
| Example 7 | 7 | A | 0.03 | A | 0.03 | A | A | A | 0 | A | 0.03 | A | 0.03 | A | 0.1% | A | 0.2% | A | 0 | A −45 |
| Example 8 | 8 | A | 0.02 | A | 0.03 | A | A | B | 2 | A | 0.04 | A | 0.04 | A | 0.0% | A | 0.1% | A | 0 | A −43 |
| Example 9 | 9 | A | 0.06 | A | 0.07 | A | C | A | 0 | A | 0.07 | B | 0.15 | A | 0.4% | B | 0.7% | A | 0 | A −42 |
| Example 10 | 10 | A | 0.05 | A | 0.05 | A | A | A | 0 | A | 0.06 | A | 0.06 | A | 0.3% | A | 0.3% | A | 0 | A −43 |
| Example 11 | 11 | A | 0.04 | A | 0.05 | A | A | A | 0 | A | 0.05 | A | 0.05 | A | 0.2% | A | 0.3% | A | 0 | A −44 |
| Example 12 | 12 | A | 0.05 | A | 0.05 | A | A | A | 0 | A | 0.04 | A | 0.05 | A | 0.2% | A | 0.3% | A | 0 | A −41 |
| Example 13 | 13 | A | 0.05 | A | 0.05 | A | A | A | 0 | A | 0.06 | A | 0.06 | A | 0.1% | A | 0.1% | A | 0 | A −46 |
| Example 14 | 14 | A | 0.05 | A | 0.06 | A | A | A | 0 | A | 0.06 | A | 0.07 | A | 0.2% | A | 0.3% | A | 0 | A −45 |
| Comparative Example 1 | 15 | A | 0.07 | C | 0.26 | A | C | B | 3 | A | 0.07 | D | 0.32 | A | 0.1% | A | 0.4% | B | 3 | A −45 |
| Comparative Example 2 | 16 | A | 0.07 | C | 0.28 | A | C | B | 4 | A | 0.08 | D | 0.33 | A | 0.2% | A | 0.4% | B | 3 | A −43 |
| Comparative Example 3 | 17 | A | 0.07 | B | 0.15 | A | D | C | 8 | B | 0.12 | D | 0.35 | B | 0.7% | D | 2.8% | D | 26 | C −27 |
| Comparative Example 4 | 18 | A | 0.06 | A | 0.08 | A | C | B | 4 | A | 0.07 | D | 0.31 | B | 0.6% | C | 1.8% | C | 8 | B −38 |
| Comparative Example 5 | 19 | A | 0.07 | D | 0.32 | A | D | A | 0 | A | 0.06 | B | 0.13 | B | 0.8% | C | 1.6% | B | 4 | B −34 |
| Comparative Example 6 | 20 | B | 0.12 | D | 0.35 | B | D | C | 9 | B | 0.12 | D | 0.38 | B | 0.9% | C | 1.7% | C | 10 | B −32 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

3. The toner according to claim 1, wherein the content of the organosilicon polymer in the toner is 0.5 to 5.0 mass %.

4. The toner according to claim 1, wherein the organosilicon polymer is a polymer comprising a structure represented by $R^a$—$SiO_{3/2}$ where $R^a$ represents a hydrocarbon group having 1 to 6 carbons or a vinyl polymer segment containing a substructure represented by formula (i) or formula (ii)

(i)

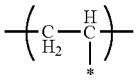

(ii)

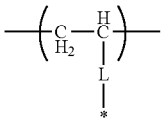

where * represents a binding segment with Si in $R^a$—$SiO_{3/2}$ and L represents an alkylene group or arylene group.

5. The toner according to claim 1, wherein the fixing ratio of said organosilicon polymer to said core particle is 92.0 to 99.0%, the methanol concentration in the wettability test is 5.0 to 20.0 volume %, and the content of the organosilicon polymer in the toner is 0.5 to 5.0 mass %.

* * * * *